United States Patent [19]

Trumbull et al.

[11] 4,450,666

[45] May 29, 1984

[54] ECONO BRICKING RING

[75] Inventors: James L. Trumbull, Seattle; William A. Gillam, Alderwood Manor, both of Wash.

[73] Assignee: Clayburn Refractories, Inc., Abbotsford, Canada

[21] Appl. No.: 411,782

[22] Filed: Aug. 26, 1982

[51] Int. Cl.[3] ..... E04G 11/20

[52] U.S. Cl. ..... 52/749; 405/146

[58] Field of Search ..... 52/749; 405/146, 148

[56] References Cited

U.S. PATENT DOCUMENTS

| | | | |
|---|---|---|---|
| 3,075,359 | 1/1963 | Clark | 52/749 |
| 3,298,155 | 1/1967 | Byfield et al. | 405/146 |
| 3,466,883 | 9/1969 | Drenkel . | |
| 3,550,344 | 12/1970 | Maier et al. | 405/146 |
| 4,363,202 | 12/1982 | Kenyon | 52/749 |

*Primary Examiner*—James L. Ridgill, Jr.

*Attorney, Agent, or Firm*—Jones, Tullar & Cooper

[57] ABSTRACT

The specification describes a bricking ring for use in positioning and temporarily retaining bricks in a circular overhead configuration. The bricking ring intended for use in lining kilns comprises a plurality of arcuate segments forming a semi-circular configuration. The segments are pivotally interconnected, and are attached to a central rigid support by means of arms the length of which is adjustable. Thus, the radius of the semi-circular configuration may be adjusted so that the bricking ring may be used in different diameter kilns or when the kiln is lined with a double layer of bricks.

17 Claims, 10 Drawing Figures

ECONO BRICKING RING

BACKGROUND OF THE INVENTION

The present invention relates to an apparatus designed to retain bricks, such as fire bricks, in an overhead, semi-circular configuration until the final or key brick is installed.

The apparatus of the invention has particular utility in the lining operation of large diameter kilns, and more specifically, the upper half thereof. Many kilns are lined without the use of mortar and, thus alternative means must be employed until the key brick is installed. The apparatus disclosed herein provides such alternative means. The apparatus also finds use in kilns in which bricks are laid up in mortar..

U.S. Pat. No. 3,466,883 issued Sept. 16, 1969 to Drenkel discloses an overhead brick laying apparatus comprising a semi-circular brick clamping frame rigidly attached to a semi-circular supporting frame. The clamping frame carries a plurality of pneumatically operated clamping means which separately and independently hold bricks in position until the overhead key brick is installed. The pneumatics of the clamping means are then deactivated so that the semi-circular supporting and clamping frames may be moved axially along the kiln and readied for the next circumferential layer of bricks.

The rigid semi-circular structures according to the prior art allow for only small variations in kiln diameters. Frequently, it is desirable to line a kiln with two or more courses in order to reduce heat losses. Also, a circular kiln may have two separate regions, each having a different diameter. The prior art structures are not adaptable to accomodate such variations short of fabricating separate frames for each diameter.

SUMMARY OF THE INVENTION

The present invention overcomes the aforementioned limitation by providing a flexible, infinitely adjustable -within a range- ring made of a series of rigid circular segments joined one to another by hinge or pivot points. The ring support structure rather than being fixed as in the prior art is adjustable by a series of segment adjustment arms fixed at the hinge points on the rigid circular segments and supported by an underlying rigid cross member.

According to the present invention, therefore, there is provided a bricking ring for use in positioning bricks in a circular configuration. The ring comprises a horizontal rigid diametric support having vertically adjustable legs and a plurality of pivotally connected rigid arcuate segments connected in a semi-circular configuration to the support by means of adjustable arms between the support and pivot connections. Each of the arcuate segments carry at least one pneumatically operated brick clamping means.

BRIEF DESCRIPTION OF THE DRAWINGS

The advantages of the apparatus of the present invention as well as the operation thereof will be apparent from the following detailed description in conjunction with the appended illustrations in which.

DESCRIPTION OF PREFERRED EMBODIMENT

Figure 1:
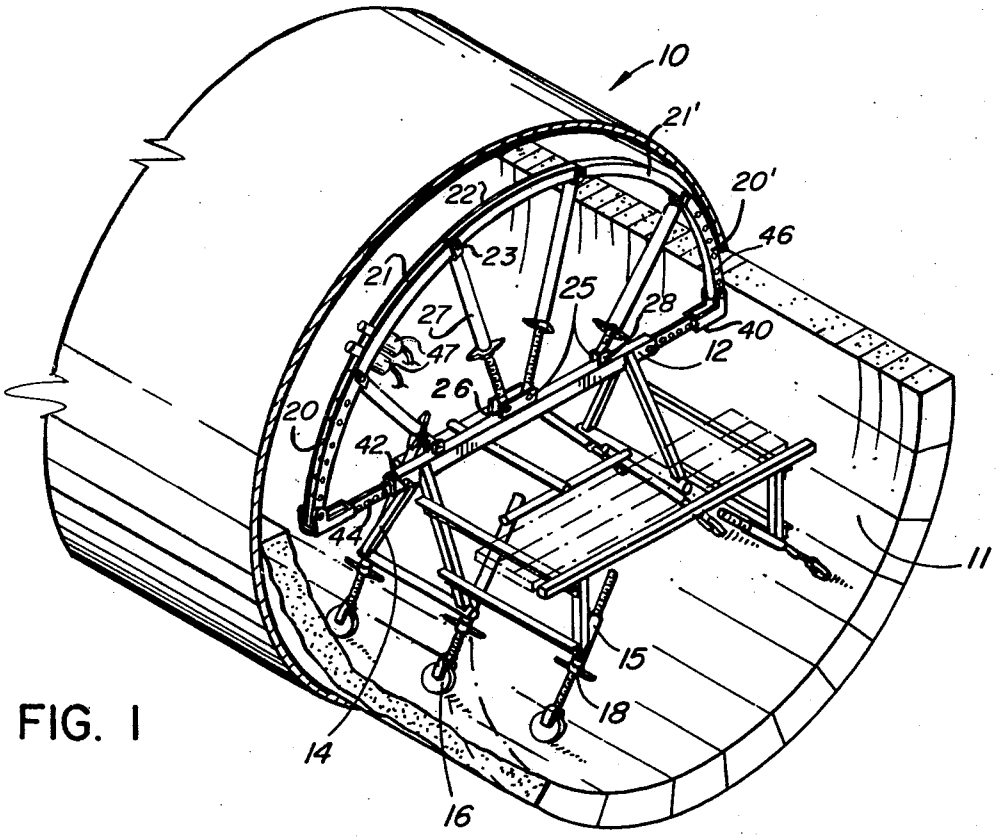
FIG. 1 is a perspective view of a circular kiln with a bricking ring according to the present invention.

Referring to FIG. 1 a circular kiln 10 is illustrated in cross section. The illustration indicates that the bottom half of the circular kiln has been lined with bricks 11 for example, fire bricks. It is contemplated that the full length of the kiln be lined up to the mid-point prior to the introduction of the bricking ring. This is, of course, not essential in that the lining may be applied completely in sections as required. The bricking apparatus includes a rigid support 12 disposed diametrically within the kiln. The rigid support in the preferred embodiment comprises an elongated, hollow square member having suitably placed, upwardly projecting fastening means 25 to be described hereinafter.

The support 12 preferably is positioned diametrically in the kiln as near to the center line thereof as possible. The support is secured to a scaffold 14 which rests on the lower portion of the lined kiln. The scaffold 14 according to the preferred embodiment is provided with height adjustment means such as screw jacks 18 built into support legs 15. The height adjustment means 18 facilitates positioning of the support 12 generally horizontally as well as centrally within the kiln. It is also contemplated that the scaffold be provided with casters 16 or the like to allow easy relocation of the apparatus within the kiln.

Figure 2:
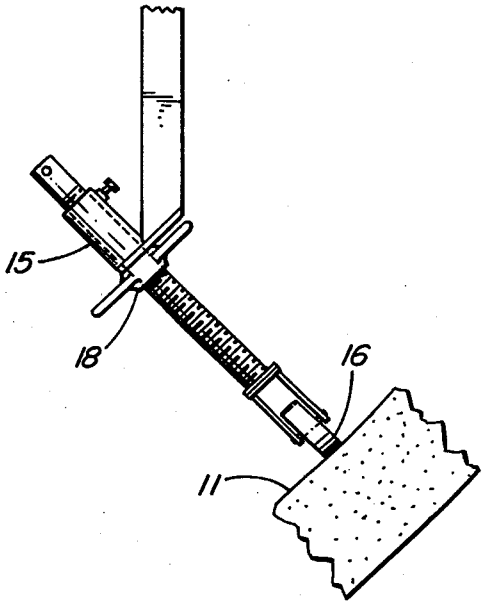
FIG. 2 illustrates the adjustable leg and caster assembly.

FIG. 2 illustrates one method whereby the casters and adjustment means are attached to the legs of the scaffold. The casters may be attached to the adjustable leg by bolts or by welding. The adjustment means comprising a threaded rod having a mating handle rotatable on the threaded rod may be adjusted to alter the length of the leg. The upper end, of the rod has a thread free section which is rotatably received in a sleeve attached to the scaffold leg. The rod may rotate within the sleeve or may be prevented from rotation by tightening a lock nut. It is understood that extensions may be added to the legs in order to increase the height of the support member. FIG. 1 illustrates a platform which rests on a platform support also secured to the scaffold. The platform which may be a series of wooden planks covered by plywood provides a work area and storage space for the brick installers. According to the embodiment illustrated in FIG. 1, the platform support has 2 additional casters which allows the platform to be moved with the bricking ring.

The hollow rigid support 12 is considerably shorter than the diameter of the kiln and in addition to the upwardly projecting fastening means is provided with small openings adjacent both ends. As indicated in FIG. 1 the openings extend through the support in a lateral direction so as to accommodate a locking pin which will be described later.

Figure 3A:
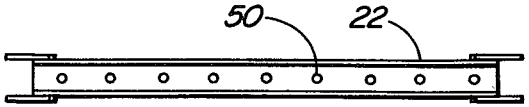
FIGS. 3A and 3B are detailed illustrations of a center rail.
Figure 3B:
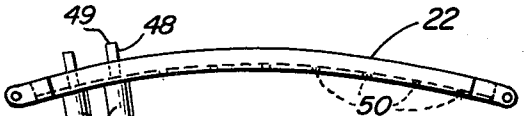
Figure 4A:
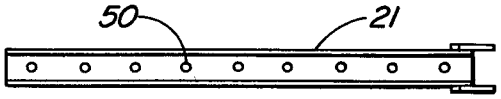
FIGS. 4A and 4B are detailed illustrations of a side rail.
Figure 4B:
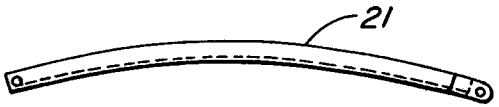

The apparatus further comprises rigid arcuate segments shown in FIGS. 3-5 which are afixed to the rigid support.

Figure 5A:
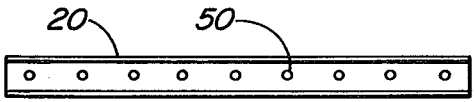
FIGS. 5A and 5B are detailed illustrations of an end rail.
Figure 5B:
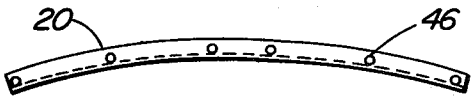

In FIG. 1, 5 such arcuate segments, 20, 20', 21, 21' and 22 are illustrated. Segment 22 (FIGS. 3A and 3B) is known as a center rail and is located at the top of the kiln. Segments 21, 21' (FIGS. 4A and 4B) are located on either side of the center rail and are known as side rails. Finally, segments 20, 20' (FIGS. 5A and 5B) complete the semi-circle and are called end rails. Although the illustration and the following description refer to segments it is to be understood that more than this number may be used as required.

The arcuate segments are interconnected via pivot means 23 so as to allow each segment to pivot with respect to the adjoining segments.

Figure 6:
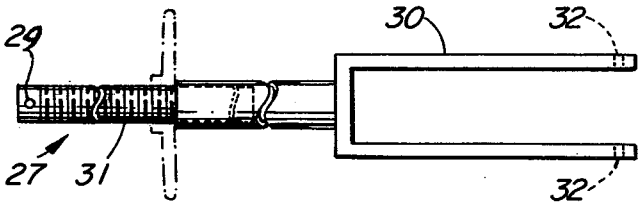
FIG. 6 illustrates an adjustable support arm.

As previously indicated, the rigid support is provided with upwardly projecting fastening means 25 suitably placed along the length thereof. The fastening means consist of complementary tab members having aligned openings 26 therethrough. An adjustable arm 27, best seen in FIG. 6 is used to interconnect the support and the arcuate segments.

As illustrated, the arm 27 is pivotally connected to the support by securing pin 28 through opening 29 in the arm 27 and opening 26 in the fastening means. The opposite end of the arm 27 pivotally joins the connection point between the arcuate segments. As shown in FIG. 6, end 30 of the arm consists of a pair of spaced apart legs having an aligned opening 32 therethrough adjacent one end thereof. The legs stradle the arcuate segments and are pivotally connected thereto. Each adjustable arm is provided with adjustment means 31 such as a screw jack to conveniently permit adjustment of the length of the arm.

Figure 7:
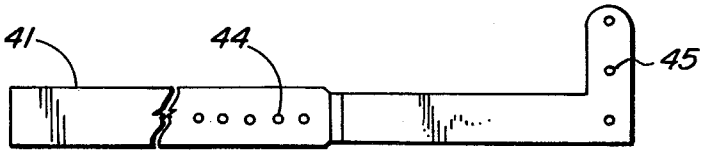
FIG. 7 illustrates a lockable end support.

A further adjustment is provided by end supports 40 associated with the rigid support 12. End supports 40 illustrated in FIG. 7 each include one end 41 adapted to slide inside the hollow square configuration of the support and to be secured therein by locking pin means 42 through openings 43 in the support and openings 44 in the end support. The outer end of the end support is provided with openings 45 adapted to receive and secure thereto end rail 20, 20'.

As will be noted from FIG. 5B, end rail 20, 20' has a series of holes 46 projecting laterally through the arcuate segment, thus allowing for a further adjustment of the ring diameter.

Associated with each rail although not specifically illustrated are a plurality of pneumatically operated brick clamping means, which project through holes 50. Each of the clamping means is in the form of a cylinder with a smooth end which bears against the brick. The smooth end may be covered with rubber or soft plastic pads although it has been found that a smooth steel face is preferable. The rubber pads tend to hold the bricks so as to make final positioning more difficult. Further, it has been observed that little or no damage is done to the brick by the steel face provided the pressure in the cylinder is kept in the proper range.

In operation, the lower half of a cylindrical kiln is lined with fire bricks. The apparatus of the present invention is placed within the kiln and suitably located therein to permit positioning of a first course of bricks. The adjustable legs associated with the scaffold are arranged so that the rigid support is located diametrically horizontally at substantially the middle of the kiln. End supports 40 are slidably located in the rigid support but not secured thereto. The pivotally connected arcuate segments are pinned to the fastening means on the support via the adjustable arms 27.

One of the end supports is attached to the appropriate end rail 20, 20' and locked to the support at a location which provides approximately 1' clearance between the end rail and the predicted inner diameter of the kiln following brick installation.

Arms 27 are then adjusted sequentially, beginning with the arm next to the locked end support, so that the approximate gap between the arcuate segments and the predicted inner diameter of the kiln is 1 inch. When all of the adjustments have been completed, the locking pin in the first end support is removed and the ring or series of segments is rotated if necessary, on the adjustable support arms to insure that the mid-point of the ring is as close to being centered at the top (12 o'clock) of the kiln as possible. Both end supports are then locked to hold the bricking ring in position.

Lining of the kiln then proceeds by placing bricks around the inner surface of the kiln. As each brick is placed between the kiln and bricking ring, the pneumatically actuated clamping means are activiated so as to retain the bricks in place. When the last or key bricks has been secured, the pneumatic clamps are deactivated and the bricking ring moved along the kiln to provide support for the placement of the next series of bricks.

If a second course of bricks is to be installed the adjustable arm 27 are arranged so that the arcuate segments define the new inner diameter of the kiln. A second course of bricks is installed and clamped as before.

A similar procedure is followed in the case of a kiln having sections of different diameters.

The embodiments of the invention in which an exclusive property or privilege is claimed are defined as follows:

1. A bricking ring for use in positioning bricks in an overhead arcuate configuration, comprising:

a rigid, laterally disposed, adjustable support member;

vertically adjustable leg means secured to said support member for positioning said support member;

a plurality of rigid arcuate rail segments pivotally interconnected end-to-end to form a generally semicircular configuration;

a plurality of segment adjustment arms, each arm extending between and connected at its opposite ends to said support member and to a corresponding pivotal interconnection between adjacent rail segments, one adjustment arm being connected to each said interconnection; and adjustment means for selectively lengthening or shortening each of said adjustment arms.

2. The bricking ring of claim 1, further including at least one pneumatically activated brick clamping means projecting through each of said rail segments and adapted to engage a brick to be held in place in an overhead arcuate configuration.

3. The bricking ring of claim 2, wherein said adjustment means for each said adjusting arm comprises manually operable jack means.

4. The bricking ring of claim 3, wherein said adjustable support member includes movable end support means connected at each end of said support member.

5. The bricking ring of claim 4, further including adjustment means on at least two of said rail segments for varying the diameter of said semicircular configuration.

6. The bricking ring of claim 1, wherein each of said arcuate rail segments includes a plurality of spaced, radially-extending holes, each hole being located to receive a corresponding pneumatically operated brick clamping means.

7. The bricking ring of claim 6, further including pneumatically operated brick clamping means mounted to extend through at least one of each said holes in each rail segment.

8. A bricking ring for use in positioning and temporarily holding bricks in an overhead circular configuration comprising a laterally disposed rigid support member; a plurality of pivotally interconnected arcuate segments pivotally connected to said support member by means of segment adjustment arms; and at least one pneumatically activated brick holders carried by each of said arcuate segments.

9. A bricking ring according to claim 8 wherein said support member includes means to carry a platform.

10. A bricking ring according to claim 8 wherein said support member has longitudinally adjustable leg members.

11. A bricking ring according to claim 10 wherein each of said adjustable leg members are provided with a caster 12. A bricking ring according to claim 11 wherein said casters are rotatably connected to said adjustable leg members.

13. A bricking ring for use in positioning and temporarily holding bricks overhead in a cylindrical kiln comprising: a rigid support member diametrically disposed within said kiln by means of support legs having height adjustment means; a plurality of arcuate segments forming a substantially semi-circular configuration each of said segments being pivotally joined to the adjacent segments; longitudinally adjustable support arms pivotally interconnecting said arcuate segments to said rigid support member; two end support members adapted to join the ends of the semi-circular configurations to said support structures and; a plurality of pneumatically activated brick support cylinders carried by each of said arcuate segments.

14. A bricking ring according to claim 13 further including platform supporting means rigidly attached to said support member, said platform supporting means having height adjustable legs with rotatable casters attached thereto.

15. A bricking ring according to claim 13 comprising five arcuate segments.

16. A bricking ring according to claim 15 wherein said five arcuate segments including one center segment, two side segments and two end segments forming a semi-circular configuration.

17. A bricking ring according to claim 5 having four adjustable support arms pivotally attached to the junction between said arcuate segments and to said rigid support member.

* * * * *

UNITED STATES PATENT AND TRADEMARK OFFICE

CERTIFICATE OF CORRECTION

PATENT NO. : 4,450,666

DATED : May 29, 1984

INVENTOR(S) : William A. Gillam et al.

It is certified that error appears in the above-identified patent and that said Letters Patent is hereby corrected as shown below:

On the title page inventors should read

-- (75) Inventors: William A. Gillam, Alderwood Manor; James L. Trumbull, Seattle, both of Washington --.

Signed and Sealed this

*Twenty-sixth* Day of *March 1985*

[SEAL]

*Attest:*

DONALD J. QUIGG

*Attesting Officer* *Acting Commissioner of Patents and Trademarks*